US005319886A

United States Patent [19]

Steere, Jr.

[11] Patent Number: 5,319,886

[45] Date of Patent: Jun. 14, 1994

[54] TOOL MOUNTING ARRANGEMENT

[75] Inventor: Robert E. Steere, Jr., Boonton, N.J.

[73] Assignee: Silicon Technology Corporation, Oakland, N.J.

[21] Appl. No.: 76,394

[22] Filed: Jun. 14, 1993

[51] Int. Cl.[5] ..... B24B 41/00

[52] U.S. Cl. ..... 51/168; 409/234; 83/666

[58] Field of Search ..... 51/168, 209 R; 409/232, 409/233, 234; 83/666

[56] References Cited

U.S. PATENT DOCUMENTS 4,393,626 7/1983 Schroer ..... 51/168

4,638,601 1/1987 Steere et al. ..... 51/165.71

*Primary Examiner*—Roscoe V. Parker

*Attorney, Agent, or Firm*—Francis C. Hand

[57] ABSTRACT

The tool mounting arrangement employs a bushing within a recessed end of a shaft. The bushing has three lobes with inclined surfaces which abut against an internal conical wall of an annular mounting portion on the end of the shaft. A threaded screw passes through a washer and the grind wheel in non-rotatable relation into threaded relation in the bushing. Turning of the screw causes the bushing to be pulled in a direction out of the shaft so as to radially deform the annular mounting portion into uniform contact with the bore of the grind wheel while the grind wheel is simultaneously abutted square to the shaft axis. The annular mounting portion is provided with equi-spaced circumferentially disposed notches to permit passage of the lobes upon insertion of the bushing into the recess at the end of the shaft. One or more set screws is also provided in the shaft to prevent rotation of the bushing within the recess of the shaft.

15 Claims, 1 Drawing Sheet

TOOL MOUNTING ARRANGEMENT

This invention relates to a tool mounting arrangement. More particularly, this invention relates to a mounting arrangement for a grind wheel on a shaft.

As is known, various types of techniques have been employed for mounting one tool part on another. For example, it has been known to mount a grind wheel or disc on a shaft in a manner wherein the grind wheel is centered and made true relative to the shaft axis. In the case of silicon wafer edge profiling or grinding machines, it has been known to center and true the grind wheel by using very close tolerances to position the wheel on the center of the shaft. It has also been known to center and true the wheel by providing loose tolerances and manually shifting the wheel to the center of the shaft as determined by a displacement indicator.

However, the techniques employed for centering grind wheels on shafts have several disadvantages. In the first case, the holding of close tolerances between the wheel and the shaft is rather expensive. Further, the wheel is difficult to install and remove with the risk of binding or scouring of the shaft. Still further, the wheel is never assured to be centered as long as a clearance remains.

The disadvantages of the second technique is that such requires a skilled operator as well as trial and error centering. In addition, an extra amount of time is required for the trial and error centering.

Accordingly, it is an object of the invention to be able to center, true and secure a grind wheel on a shaft automatically by tightening a single fastening screw.

It is another object of the invention to be able to and center, true and secure a grind wheel on a shaft in a relatively simple, inexpensive manner.

It is another object of the invention to provide a relatively simple tool mounting arrangement for mounting two parts together.

Briefly, the invention provides a tool mounting arrangement which comprises a first part including an annular mounting portion and a radial abutting portion wherein the annular mounting portion has an internal conical wall disposed on a first axis and an external wall concentric to the internal wall while the radial portion has a surface square (i.e. perpendicular) to the first axis. The arrangement also has a second part mounted on the annular mounting portion about the external wall. In addition, the arrangement includes a bushing which is disposed within the annular mounting portion and means for pulling the bushing along the axis of the first part in a direction out of the annular mounting portion to radially deform the annular mounting portion into contact with the second part while abutting the second part against the radial abutting portion in order to secure the second part to the first part. In this construction, the bushing includes a plurality of circumferentially spaced apart lobes which project radially outwardly into contact with the internal wall of the annular mounting portion.

In one embodiment, the first part is in the form of a shaft while the second part is in the form of an annular disc or grind wheel. In this respect, the shaft may be part of an assembly of a grind wheel spindle shaft assembly of an edge profiler for grinding the edge of a silicon wafer or the like. Such a grinding machine is described in U.S. Pat. No. 4,638,601.

In this embodiment, the radial abutting portion is provided on the mounting end of the shaft square to the shaft axis and at the back end of the annular mounting portion. This allows the grind wheel to abut true to the shaft axis while being secured.

The means for pulling the bushing in a direction to effect centering of the grind wheel may include a washer which abuts the grind wheel on a side opposite from the shaft and a screw which has a head abutting the washer and a threaded shank which passes through into threaded engagement with the bushing. Thus, upon rotation of the screw relative to the washer and grind wheel, the bushing can be made to move longitudinally along the axis of the shaft relative to the annular mounting portion of the shaft and the grind wheel.

A suitable stop means is also provided on the shaft for preventing the bushing from rotating within the shaft. For example, the stop means may be in the form of at least one set screw which is threaded into the shaft radially of the shaft axis and which is disposed in a recess in a circumferential surface of the bushing.

The annular mounting portion is also provided with a plurality of circumferentially spaced apart notches for passage of the respective lobes of the bushing therethrough for mounting of the bushing within the shaft and for removal of the bushing, when desired from the shaft.

In addition, the shaft can be provided with a threaded bore for selectively receiving a mounting screw for securing the grind wheel on the shaft when the bushing is not to be used. In this case, the bushing is removed from the shaft completely.

These and other objects and advantages of the invention will become more apparent from the following detailed description taken in conjunction with the accompanying drawings wherein.

Figure 1:
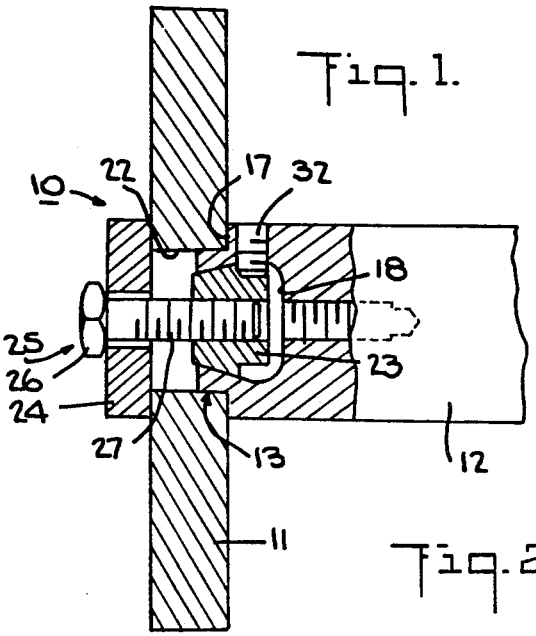
FIG. 1 illustrates a partial cross-sectional view of a tool mounting arrangement for mounting a grind wheel on a shaft in accordance with the invention.

Referring to FIG. 1, the tool mounting arrangement 10 is constructed for mounting a grind wheel or disc 11 on a shaft 12.

Figure 3:
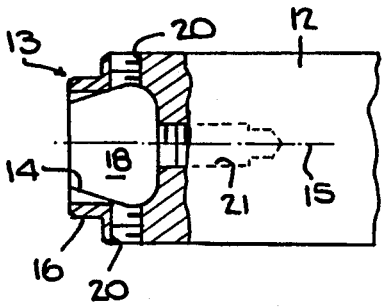
FIG. 3 illustrates a cross-sectional view of the mounting end of the shaft of the tool mounting arrangement of FIG. 1.

Referring to FIGS. 1 and 3, the mounting arrangement 10 includes an annular mounting portion 13 on one end of the shaft 12 having an internal wall 14 disposed about an axis 15 of the shaft 12 on a conical angle, for example, an angle of 15° relative to the axis 15. That is to say, the internal wall 14 has an included angle of 30°. In addition, the annular mounting portion 13 has an external wall 16 concentric to the internal wall 14. This external wall 16 defines a cylindrical surface having a diameter, e.g. of 0.787 inches and length of 0.185 inches which terminates at a shoulder 17 of the shaft 12 which, in turn, defines a radially disposed surface of radial abutting portion of the shaft 12. The surface of the shoulder 17 is thus square to the axis 15 of the shaft 12.

As indicated, the shaft 12 is of solid construction so as to define a recess 18 at one end which extends from within the shaft 12 and through the annular mounting portion 13. As indicated, the recess 18 narrows in the direction of the end of the shaft 12 and is of trapezoidal shape in cross-section with a length of 0.50 inches.

Figure 4:
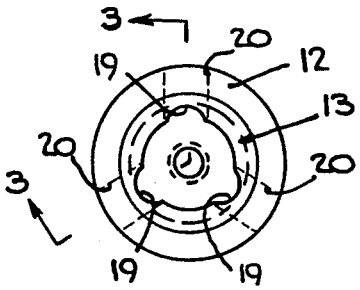
FIG. 4 illustrates an end view of the shaft end of FIG. 3.

Referring to FIGS. 3 and 4, the annular mounting portion 13 includes a plurality of circumferentially spaced apart notches 19, for example, disposed in equispaced relation at an angle of 120° relative to each other for purposes as described below. In addition, a plurality of circumferentially spaced apart threaded bores 20 are formed in the shaft 13 to pass radially into the recess 18.

Still further, as shown in FIG. 3, the shaft 12 is provided with a threaded bore 21 on the axis 15 for selectively receiving a mounting screw (not shown).

Figure 2:
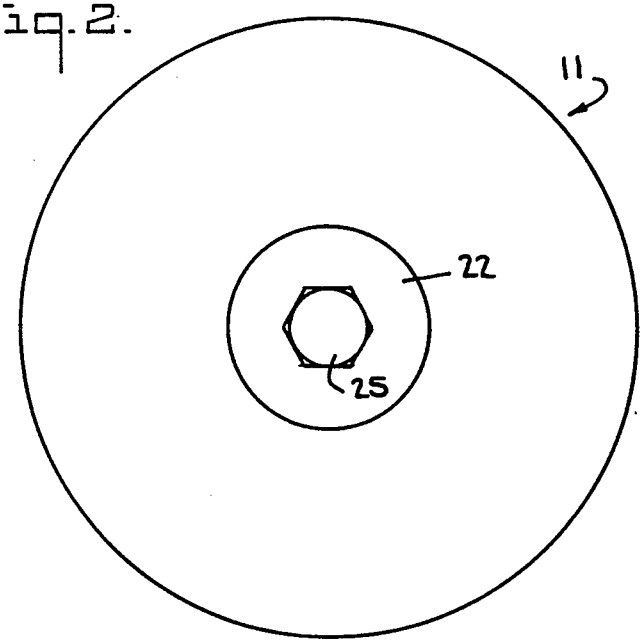
FIG. 2 illustrates a front view of the mounting arrangement to FIG. 1.

Referring to FIGS. 1 and 2, the grind wheel or disc 11 is of annular shape and has a centrally disposed bore 22 for receiving the annular mounting portion 13 of the shaft 12.

The mounting arrangement 10 for mounting the grind wheel 11 on the shaft 12 includes a bushing 23 which is disposed within the annular mounting portion 13 and within the recess 18 of the shaft 12. In addition, the mounting arrangement 10 includes a means for pulling the bushing 23 along the axis 15 of the shaft 12 in a direction out of the annular mounting portion 13 in order to radially deform the annular mounting portion 13 outwardly into contact with the grind wheel 11 so as to secure the grind wheel 11 to the shaft 12.

Figure 5:
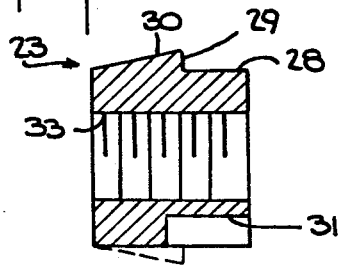
FIG. 5 illustrates a cross-sectional view of a bushing constructed in accordance with the invention.
Figure 6:
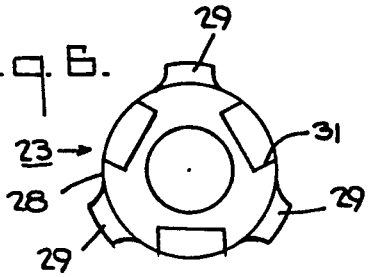
FIG. 6 illustrates an end view of the bushing of FIG. 5.

Referring to FIGS. 1 and 2, the mounting arrangement 10 includes a washer 24 which abuts the grind wheel 11 on a side opposite from the shaft 12 and screw 25 having a head 26 which abuts the washer 24 and a threaded shank 27 which passes through the washer 24 and grind wheel 11 in nonthreaded relation and into threaded engagement with the bushing 23. Referring to FIGS. 5 and 6, the bushing 23 is of annular shape with a cylindrical surface 28 of an outside diameter, e.g. 0.500 inches, which is smaller than the diameter of the mouth of the annular mounting portion 13 which may be 0.510 inches. The bushing 23 also includes a plurality of circumferentially spaced apart lobes 29, for example, three which are equally-spaced about the bushing 23, for example, on an angle of 120° relative to each other. The lobes 29 are disposed so as to project radially outwardly from the cylindrical surface 28, for example, a distance of 0.05 inches into contact with the internal wall 14 (see FIG. 3) of the annular mounting portion 13. As illustrated in FIG. 5, each lobe 29 has an outer surface 30 facing the internal wall 14 (see FIG. 3) of the annular mounting portion 13. This outer surface 30 is disposed on an angle relative to the axis 15 of the shaft 12 which angle is less than the conical angle of the internal wall 14. For example, where the internal wall 14 has a conical angle of 15°, the inclined surface 30 of each lobe 29 is on an angle of 12°.

In addition, the bushing 23 has a length, e.g. of 0.480 inches and a plurality of circumferentially spaced apart recesses 31, for example, three which are equally-spaced over an angle of 120° relative to each other.

Referring to FIG. 1, a stop means is also provided on the shaft 12 for preventing the bushing 23 from rotating within the shaft 12. For example, the stop means includes a plurality of set screws 32 (only one of which is shown) which are threaded into the bores 20 of the shaft 12 radially of the axis 15. Each screw 32 is disposed so as to be received within a respective recess 31 of the bushing 23.

The bushing 23 also includes a threaded bore 33 which extends completely through the bushing 23. As indicated in FIG. 1, the bore 33 is sized so as to receive the threaded shank 27 of the fastening screw 25. In addition, when the bushing 23 is not to be used, a long mounting screw (not shown) may be used which threads into the threaded bore 21 (see FIG. 3) in the shaft 12. This accomodates the use of the previously known techniques for centering and trueing the wheel 11, if desired.

In order to mount the grind wheel 11 on the shaft 12, the bushing 23 is first mounted within the recess 18 of the shaft 12. In this respect, the bushing 23 is installed by aligning the lobes 29 with the clearance notches 19 (see FIG. 4) and inserting the bushing 23 axially into the recess 18. Once inserted, the bushing 23 is turned, for example, 60°. At this point, the three set screws 32 are turned inward relative to the shaft 12 so as to enter into the respective recesses 31 of the bushing 23 to keep the bushing 23 from rotating. In this respect, the set screws 32 are not tightened against the bushing 23 but only retain the bushing 23. Further, one set screw 32 would be sufficient to prevent rotation; however, three set screws 32 are used in order to keep the shaft 12 in balance when rotating.

Once the bushing 23 has been put in place, the grind wheel 11, if not previously mounted on the annular mounting portion 13, is slid onto the annular mounting portion 13 of the shaft 12 and abutting against the should 17. Next, the washer 24 is abutted against the grind wheel 11 and the fastening screw 25 is passed through the washer 24 and grind wheel 11 into threaded engagement with the bore 33 of the bushing 23. As the fastening screw 25 is further rotated, the bushing 23 is pulled in a direction towards the grind wheel 11 so as to radially deform the annular mounting portion 13. In this respect, the three lobes 29 of the bushing 23 assure equal contact pressure of the wedging force. Further, the inclined angle of the surfaces 30 of the respective lobes 29 and the conical angle of the internal wall 14 of the annular mounting portion 13 assure a line contact at the inner forward rim of the shaft 12 for uniformity of expansion leverage. In this respect, the contact pressure of the wedge-shaped bushing 23 should be kept within the material stress limits to prevent deformation of any parts in the working range.

During assembly, as the fastening screw 25 is tightened, the bushing 23 expands the annular mounting portion 13 uniformly in a radial manner removing all clearance between the mounting portion 13 and the grind wheel 11. This shifts the wheel 11 and centers the wheel 11 on the shaft 12 automatically. Simultaneously, the wheel 11 is abutted against the shoulder 17 further trueing the wheel square to the shaft axis 15.

The pulling force exerted on the bushing 23 to expand the annular mounting portion 13 of the shaft 12 to center the grind wheel 11 should not be so great as to prevent centering. In other words, the annular mounting portion 13 of the shaft 12 should be constructed to expand relatively easily over the full working range without requiring excessive force of the fastening screw 25. Otherwise, the grind wheel 11 may be clamped too tightly from the start in an axial manner against the shoulder 17 of the shaft 12 to allow the wheel 11 to shift radially.

The mounting arrangement can be utilized to fasten or position two parts together in a generally repetitious, automatic, self-centering true manner.

The construction of the bushing and the annular mounting portion 13 of the shaft 12 permits the bushing 23 to be installed into the end of the shaft from the front.

The invention thus provides a tool mounting arrangement which does not require close tolerances between the grind wheel and shaft. Further, the invention provides a mounting arrangement which permits the mounting and centering of a grind wheel on a shaft or the like from one side so that assembly can be simplified and rapidly made. Further, the invention avoids any need for a trial and error centering of the grind wheel on the shaft. Still, the invention eliminates any clearance between the grind wheel and shaft during mounting and assembly of the grind wheel on the shaft.

What is claimed is:

1. A tool mounting arrangement comprising a first part including an annular mounting portion and a radial abutting portion, said annular mounting portion having an internal conical wall disposed on a first axis and an external wall concentric to said internal wall;

a second part mounted on said annular mounting portion about said external wall and abutted against said radial abutting portion;

a bushing disposed within said annular mounting portion, said bushing having a plurality of circumferentially spaced apart lobes projecting radially outwardly thereof into contact with said internal wall of said annular mounting portion; and means for pulling said bushing along said axis in a direction out of said annular mounting portion to radially deform said annular mounting portion outwardly into contact with said second part while abutting said second part against said radial abutting portion to secure said second part to said first part.

2. A tool mounting arrangement as set forth in claim 1 wherein said means includes a washer abutting said second part on a side opposite from said first part and a screw having a head abutting said washer and a threaded shank passing through said washer into threaded engagement with said bushing.

3. A tool mounting arrangement as set forth in claim 2 which further comprises stop means on said first past for preventing said bushing from rotating with said first part.

4. A tool mounting arrangement as set forth in claim 3 wherein said bushing includes at least one recess in a circumferential surface thereof and wherein said stop means includes at least one set screw threaded into said first part radially of said axis and disposed in said recess.

5. A tool mounting arrangement as set forth in claim 1 wherein said first part is a shaft and said second part is an annular disc.

6. A tool mounting arrangement as set forth in claim 5 wherein said shaft has a recess at one end within said annular mounting portion receiving said bushing.

7. A tool mounting arrangement as set forth in claim 6 wherein said shaft has a threaded bore on said axis for selectively receiving amounting screw for securing said disc on said shaft.

8. A tool mounting arrangement as set forth in claim 1 wherein said annular mounting portion has a plurality of circumferentially spaced apart notches for passage of said respective lobes of said busing therethrough for mounting and removal of said bushing relative to said first part.

9. In combination a shaft having an annular mounting portion and a shoulder at one end, said portion including a conical internal wall disposed on a first axis and an external wall concentric to said internal wall, said shoulder having a radial abutting surface perpendicular to said first axis.

a grind wheel mounted on said annular mounting portion about said external wall and against said shoulder;

a bushing disposed within said annular mounting portion, said bushing having a plurality of circumferentially spaced apart lobes projecting radially outwardly thereof into contact with said internal wall of said annular mounting portion; and means for pulling said bushing along said axis in a direction out of said annular mounting portion to radially deform said annular mounting portion outwardly into contact with said wheel while abutting said wheel against said shoulder to secure said wheel said shaft.

10. The combination as set forth in claim 9 wherein said means includes a washer abutting said wheel and a screw having a head abutting said washer and a threaded shank passing through said washer into threaded engagement with said bushing.

11. The combination as set forth in claim 9 which further comprises stop means on said shaft for preventing said bushing from rotating within said shaft.

12. The combination as set forth in claim 11 wherein said bushing includes at least one recess in a circumferential surface thereof and wherein said stop means includes at least one set screw threaded into said shaft radially of said axis and disposed in said recess.

13. The combination as set forth in claim 9 wherein said internal wall is disposed on a conical angle and each said lobe has an outer surface facing said internal wall of said annular mounting portion, said surface being disposed on an angle relative to said axis less then said conical angle of said internal wall.

14. The combination as set forth in claim 9 wherein said shaft has a threaded bore on said axis for selectively receiving a mounting screw for securing said wheel on said shaft.

15. The combination as set forth in claim 9 wherein said annular mounting portion has a plurality of circumferentially spaced apart notches for passage of said respective lobes of said bushing therethrough for mounting and removal of said bushing relative to said shaft.

* * * * *